United States Patent [19]

Jennings

[11] Patent Number: 4,776,583

[45] Date of Patent: Oct. 11, 1988

[54] RECUMBENT EXERCISE APPARATUS

[76] Inventor: Russell A. Jennings, Wichita Falls, Tex.

[21] Appl. No.: 591,817

[22] Filed: Mar. 21, 1984

[51] Int. Cl.[4] ..... A63B 21/00

[52] U.S. Cl. ..... 272/73; 128/25 R

[58] Field of Search ..... 272/73, 900, 130, 134; 128/25 R, 25 A; 297/161, 170, 303

[56] References Cited

U.S. PATENT DOCUMENTS

| | | | |
|---|---|---|---|
| 689,758 | 12/1901 | Shaw | 297/170 |
| 2,206,038 | 7/1940 | Ford | 128/25 R |
| 2,261,355 | 11/1941 | Flynn | 128/25 R |
| 3,730,174 | 5/1973 | Madison | 128/25 R |
| 3,831,942 | 8/1974 | DelMar | 272/73 |
| 3,991,749 | 11/1976 | Zent | 128/25 R |
| 4,451,033 | 5/1984 | Nestegard | 272/73 |
| 4,478,213 | 10/1984 | Redding | 128/25 R |

*Primary Examiner*—Richard J. Apley

*Assistant Examiner*—S. R. Crow

*Attorney, Agent, or Firm*—James C. Wray

[57] ABSTRACT

Stationary exercise apparatus has a frame, a chain with a seat and back adjustably mounted on the frame and a boom extending forward from the frame. A crank shaft is journaled in a gear mount at a distal end of the boom, and cranks and pedals are connected to the crank shaft. An outer telescopic member of the boom is fixed to the frame, and an inner telescopic member slides within the outer member and is clamped to the outer member. A drive shaft extending through the inner member is coupled to a flywheel and an energy absorber with an electrical feedback controller to vary the resistance as speed varies. The chair is mounted on a trunnion on side rails mounted on upright members. The fixed portion of the boom and the forward end of the rails is supported on an upright member which is welded to the leg of an "I" shaped base.

24 Claims, 4 Drawing Sheets

RECUMBENT EXERCISE APPARATUS

BACKGROUND OF THE INVENTION

The need for regular exercise is widely recognized.

Ordinary stationary bicycles are an effective source of exercise. Their construction usually requires hands on operation, and the body posture is generally uncomfortable and unstable, prohibiting use by non-athletic or elderly people. Other devices which provide exercise may require permanent installation in gyms or may require assistance for the relatively dangerous use of free weights. Often, the exercises are strenuous. Most do not provide the benefits of extended aerobic exercise.

One of the problems which exists with the obtaining of sufficiently extended aerobic exercise is that boredom soon overtakes the person or the person does not want to set aside regular time, as is necessary for a good exercise program. In addition to the physical benefits it is believed there are mental benefits to exercise. Other devices require concentrated attention to their operation, thus, preventing the effective use of the increased mental performance during exercise.

SUMMARY OF THE INVENTION

The present invention overcomes disadvantages of the prior art.

The present apparatus and the method for its use is a system of fitness which is more than just a machine or tool which can be used to attain fitness. The present invention provides a relationship between physical exercise and mental activity.

Although terms, such as "runner's high", which is a sense of well being or heightened awareness, are used among persons who participate in sufficient exercise programs, the sense and the awareness are considered secondary by most persons who consider them at all. Most persons do not include in their basic motivations for exercising the attainment of a sense of well being and heightened awareness.

The present invention is directed to establish the well being associated with exercise as the primary factor for incorporating a sufficient exercise program into a daily lifestyle. The invention does not diminish the importance of physical aspects associated with exercise. The invention is intended to make persons aware that they should expect an improvement in their mental, as well as physcial, capabilities when following a proper diet and exercise program. There has been limited research in the area of exercise and its effect on well being and the functioning of the mind. One area where exercise has proven to be of significant value is in treating depression.

To know where to start with an exercise program, a person needs to know his present fitness level. After participation in a program over a period of time, an efficient method of testing progress is also needed.

The present invention consists of a fitness exercise unit, a computer, various electrical sensing devices to monitor metabolic functions and a recording device to permanently record test results for comparison to future tests.

The operation of the invention is as follows:

A person is seated on an exercise unit of the present invention. Sensing devices for functions, such as heart rate, oxygen uptake, blood pressure and brain activity, are attached to the person. Statistics, such as age, sex, weight and level of activity, are entered into the computer. The computer receives inputs of measured metabolic functions while the person is at rest and uses that data in conjunction with manually entered data to compute a suitable workload for the person. The person then begins exercising. The computer monitors heart rate and informs the person when a optimum target heart rate is reached. The computer continues to monitor and record metabolic functions, brain activity and an amount of work being performed by the person. The computer provides signals to the person to attempt to maintain heart rate between minimum and maximum target levels during the testing. After a predetermined length of time, the computer instructs the person to stop exercising, and the computer continues to monitor heart rate and blood pressure and records the amount of time required for those functions to return to normal resting levels. Testing is complete at that time. The computer uses data collected during the testing to evaluate overall level of fitness. The computer then gives a competitive score, for example, 0–100% for each metabolic function tested and an average score which reflects overall level of fitness. Those scores are permanently recorded and used in subsequent tests to provide scores which reflect the person's level of improvement.

Over the past few years, there has been a growing public awareness of the importance of exercise and diet in maintaining health and a sense of well being. Some of the mose recent studies have yielded conclusive evidence that persons with heart and respiratory ailments can improve their conditions through modification of diet and exercise. Those factors, coupled with the rising costs of medical care, are motivations to incorporate suitable exercise programs into daily lifestyle. However, only a small percentage of society participates in adequate daily exercise programs.

One purpose of the invention is to create an exercise fitness unit which provides an efficient tool useful by anyone, regardless of age or physical condition, to attain a good workout. Requirements for using the standard exercise unit of the present invention are the ability to sit in a comfortable seat and move one's legs. Options are available, such as hand-operated levers that are mechanically coupled to resistance units and a seatbelt for stability when the unit is being operated, especially by hand controls.

The options of the present invention are especially suited for use by persons who are not able to use their legs or by persons who may have use of only one arm or only one leg. The exercise unit also provides full body exercise when the handles and pedals are used concurrently.

Another feature of the present invention is that a person is intended to accomplish mental activities while using the exercise device. That feature may provide one of the greatest advantages of the exercise unit over other methods of exercise. The present invention was designed to allow the use of a desk or work surface, while exercising. A desk is connected to the frame. The present invention is directed at producing a synergistic relationship between mental and physical performance. The present invention was designed to incorporate the tools and conditions normally associated with mental productivity, with the tools and conditions normally associated with physical fitness. For example, chairs, paper, pencils, computers, desks, books, are normally used in conjunction with thinking, creating, mental productivity, and increased metabolic activity, increased blood flow, heart rate, and increased oxygenation are normally associated with physical exercise. It is an intention of the present invention to demonstrate that due to increased metabolic activity and increased oxygenation that there is a corresponding increase in reading speed, increased retention, increased number of creative thoughts that can occur during exercise. It is an intention of the present invention to provide a means for incorporating productive and enhanced intellectual activity during exercise, instead of exercise having to be an interruption to productive intellectual and creative activity.

The present invention is a superior tool in the area of human stress testing and research where sensitive electronic devices are used to transmit electrical activity from the body to electronic equipment for interpretation. The present invention uniquely provides a person an ability to operate over an extended period at maximum levels due to the construction of the frame, chair, boom, and gear box.

A preferred recumbent exercise apparatus has a frame and a chair connected to the frame and supported by the frame. The chair has a seat portion and back portion. A boom is connected to the frame and extends from the frame forward of the chair. The boom has a proximal end mounted beneath the chair and a distal end remote from the chair. A journal bearing is connected to to distal end of the boom and extends transverse to the boom in a generally horizontal direction. A shaft mounted in the journal bearing has first and second opposite ends. Proximal ends of the first and second cranks are connected respectively to first and second ends of the shaft. First and second pedals respectively are connected to the first and second cranks and extend generally horizontally outward from the distal ends. Energy absorbing means provide resistance to the turning of the shaft by the pedal means and cranks.

In a preferred embodiment, the boom is adjustable in length, whereby the journal bearing may be adjusted to different distances from the chair. Preferably, the boom is adjustable by telescopically varying the length of the boom adjacent the chair. The boom has a portion which slides through the frame and which is adjustable with respect to the frame to vary a distance of the journal bearing from the chair.

In one embodiment, the chair is adjustable along the frame to vary position of the chair with respect to the frame. Trunnion means connect the chair to the frame. Locking means connect to the trunnion means, whereby the chair is rotatable rearwardly and forwardly with respect to the frame, into indefinite fixed positions. The shaft, which rotates within the boom, is likewise adjustable in length to conform to adjustments made to the boom. Any known means may be employed including the use of known telescopic drive shafts of the type commonly used for PTO (Pourer Take-Off) shafts, which function similarly to the previously described adjustable boom.

Preferably, a drive shaft extends rearwardly from the distal end of the boom. Gear means at the distal end of the boom connect the crank shaft and drive shaft and increases rate of rotation of drive shaft. Energy absorbing means connected to the frame at a proximal end of the boom and connected to an end of the drive shaft adjacent the proximal end of the boom absorbs from the drive shaft energy delivered to the drive shaft by the crank shaft. A flywheel is connected to the drive shaft near the proximal end of the boom. Gauge means connected to the energy absorbing means indicate energy absorbed by the energy absorbing means and work produced on the drive shaft.

In a preferred embodiment, the boom has an outer telescopic member rigidly connected to the frame and an inner telescopic member slidable within the outer telescopic member. The inner and out telescopic members have cooperating fixtures for complementary alignment and adjustment of the inner telescopic member. For example, a mechanical locking device hinged to the outer telescoping member cooperates with a threaded fixture that engages and disengages with screw threads on the drive shaft embodied in the inner telescoping member, gear teeth and worm gear drive combination, or pin inserted through holes of the inner/outer telescopic member, clamp means mounted on the outer telescopic member and engageable with the inner telescopic member clamps the members against movement. The drive shaft extends through the inner telescopic member. Flywheel is connected to the proximal end of the drive shaft and moves relative to the movement of the inner telescopic member. In one embodiment, the drive shaft telescopes inward and outward allowing the flywheel and energy absorbing means to remain fixed in position.

In one embodiment, the energy absorbing means comprises an electrical generator coupled to the flywheel, load means electrically connected to the generator and sensing means connected to an electrical connection between the load means and the generator.

In one embodiment, the energy absorbing means comprises an electromagnetic brake coupled to the flywheel. A rate-of-rotation sensor is connected to the frame for sensing rotation of the flywheel. Current adjusting means is connected to the sensor and to the electromagnetic brake for varying braking as flywheel rotation rate varies. A magnetic brake controller means is connected to the electromagnetic brake and control means connected to the frame adjacent the chair, whereby a user may control ratio of braking to flywheel speed.

In one embodiment, the energy absorbing means comprises a rotating disc connected to the flywheel and a disc braking pad connected to the speed sensing means is connected to the frame for sensing speed of the flywheel. Feedback means is connected to the speed sensing means and to the disc braking pad for adjusting the pad as the speed of the flywheel varies. A control means is connected to the feedback means for controlling ratio of the feedback compared to the flywheel rotation, whereby a user may adjust a ratio of braking to speed.

In a preferred embodiment, the energy absorbing means is a pump connected to the frame and coupled to the flywheel. Intake and output means are connected to the pump. A hydraulic fluid reservoir is connected to the frame and to the intake means for supplying hydraulic fluid to the pump. A flow control means connected to the valve controls resriction of the valve. A pressure transducer connected to the output converts hydraulic pressure in the output to electrical voltage. A meter connected to the transducer indicates power. Feedback means connected to the transducer means and to the control means controls the valve in response to electrical output of the transducer. A smoother is connected to the output for smoothing pressure surges in the output.

Preferably, the frame has a longitudinal base member generally parallel to the boom. A transverse base member connected to the distal end of the longitudinal base member resists rotation around an axis of the base member. A member extending upwardly from a medial portion of the longitudinal base member is connected to the boom for supporting the boom. A rear transverse member is connected to the proximal end of the longitudinal base member. Upright members are connected to the rear transverse member. Upright members are connected to the rear transverse member. Rail members connected to the upper members extend generally horizontally and forwardly and generally parallel to the longitudinal base member. A cross member connected to the rail members supports the boom. Trunnion means are connected to the rail members, and the chair is connected to the trunnion means.

Preferably, seatbelt means connected to the rail members extend upward over the seat.

A desk connected to the rail members extends above the seat portion of the chair and forward the chair for permitting a user to read or write while exercising.

One embodiment includes first and second connecting rods. First and second handles respectively are mounted on proximal emds of the connecting rods near the chair. First and second connectors respectively connect distal ends of the connecting rods to the pedals at distal ends of respective first and second cranks. Preferably, a transverse rod is connected to the frame means beneath the boom. Proximal ends of first and second idler rods respectively are connected to first and second ends of the transverse rod. Distal ends of the first and second idler rods respectively are hinged to medial portions of the connecting rods, whereby the handles are supported upward near the chair.

Preferably, toe clips are connected to the pedals for providing lifting and pulling flexure exercise to a user, as well as pushing extension exercise to a user.

In a preferred embodiment of the present invention it is useful to convert the human power input from a relatively slow, for example, 60–120 rpm, erratic form of energy, to a higher speed, for example 900–1800 rpm, smoother form of energy. This is accomplished by a combination of the gearbox that is mounted on the distal end of the boom, which not only changes the direction of output 90 degrees transverse to the input, but also multiplies the rate of rotation, for example 15 times the input, some applications may be more or less. It is the increased rate of rotation and decreased torque in the output shaft that allows for the useful application of a flywheel, which is a key to smoothing out the relatively slow, erratic human input. Therefore, the pedals, speed increaser gear box, and flywheel operate as an intergrated system. The energy absorbing means, whether hydraulic, electrical, mechanical, or solid state operate more effectively when their energy input has been converted to the high speed, relatively smooth form of energy. By the application of the high speed relatively smooth energy inputs into the energy absorbing systems, the person exercising is able to experience a more rhythmic state of work, which requires less concentration on the workout, therefore allowing more freedom to think, read or otherwise enjoy the workout with a minimum amount of distraction, or unnecessary mental fatigue.

In one embodiment of the present invention, the use of the flywheel is disengaged or removed for applications of specific dynamic testing of leg strength and form during different angles of the pedal stroke and testing dynamics of arm strength and form during different angles of hand operated levers.

In a preferred embodiment of the present invention a housing, for example, plastic, fiberglass, or metal covers the mechanical members and/or parts or all of the frame for neatness of appearance, acoustic insulation, and safety.

In one embodiment of the present invention arm rests and or hand hold grips are attached to the left and right side rails of the frame to provide extra stability and minimize unnecessary fatigue of arms when not being used.

The present system of the invention of converting the relatively slow speed, erratic human inputs into high speed smoother outputs is useful for powering, for example, human powered boats, recumbent bicycles and other wheeled vehicles, generators, human powered aircraft, or other devices where human energy input is required.

These and other and further objects and features of the present invention are apparent in the disclosure, which is the above and ongoing written description, including the claims, and the drawings.

DETAILED DESCRIPTION OF THE DRAWINGS

Figure 1:
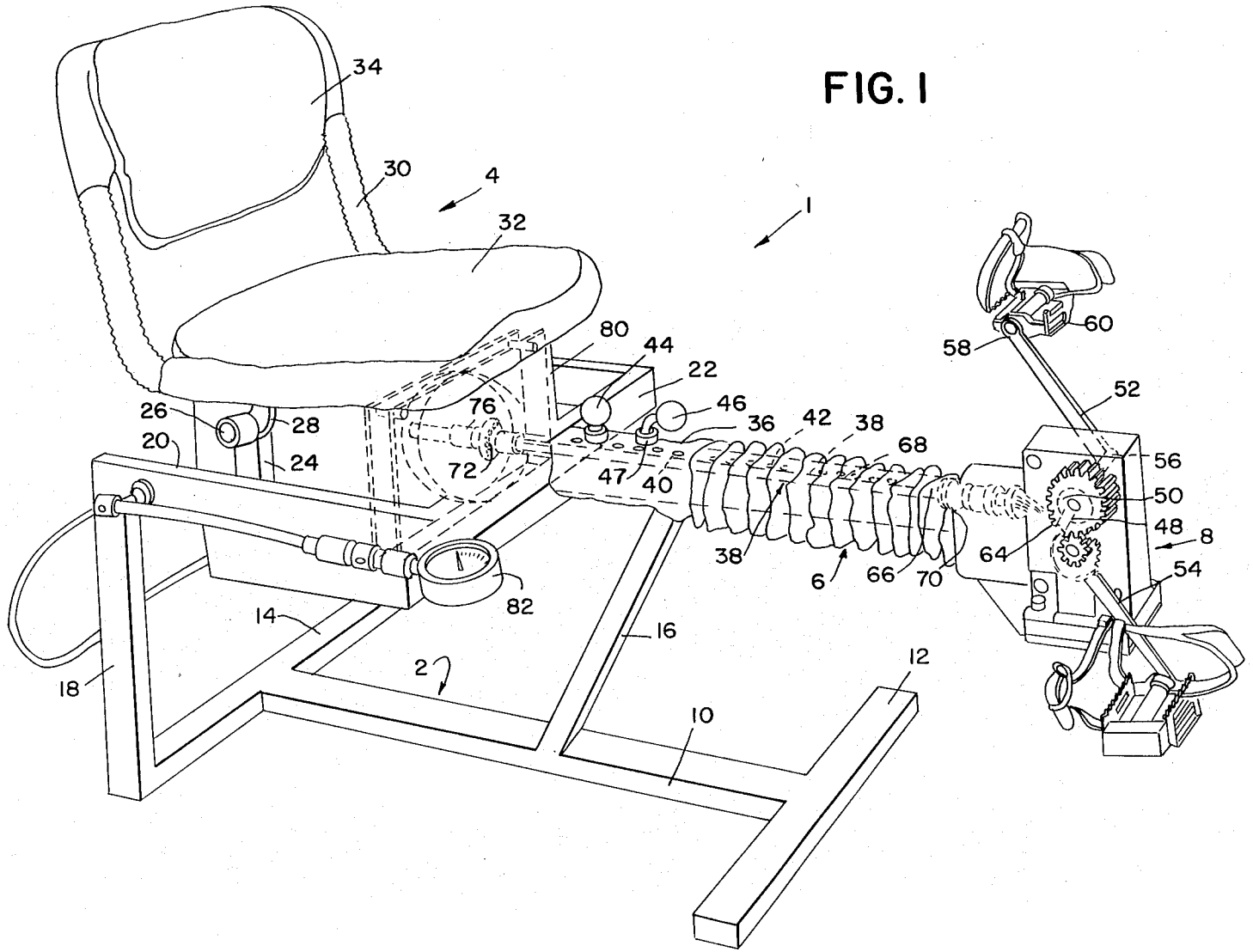
FIG. 1 is a perspective view of a preferred exercising apparatus of the present invention.

Referring to FIG. 1, an exercise apparatus is generally indicated by the numeral 1. The exercise unit has a frame 2, a chair 4, a boom 6 and work input unit 8 on the distal end of the boom 6.

Frame 2 has an "I" shaped base with a longitudianl member arm 10 and front and rear transverse members 12 and 14. Vertical member 16 slopes outwardly and forwardly from the central arm 10. Vertical members 18 extend upward from opposite ends of the rearward transverse member 14. Rails 20 extend forward from upper ends of the vertical members 18 and frontal member 22 connects front ends of the rails.

Trunnion mounts 24 extend upward from rails 20 and may be adjustable to slide along the rails. Trunnions 26 are mounted on the trunnion mounts and seat supports 28 are connected to the trunnions 26. The seat 4 has a frame 30 with a seat portion 32 and a back portion 34. The seat frame 30 is formed of one continuous loop of tubular metal. In an alternative arrangement, the frame 30 may be formed with hinges between the seat and back members to permit tilting of the back member to a desired angle.

Boom 6 has a rigid portion 36 connected to the frontal member 22 of the frame 2 and to the upright member 16. The rigid boom portion 36 comprises an outer telescopic member. An inner telescopic member 38 slides within the outer telescopic members. Complementary holes 40 and 42 are selectively aligned to receive length-fixing pin 44, which is dropped into the aligned holes by the user. Clamping member 46 is turned within the threaded collar 47, which is welded to the outer telescopic member 36. A lower end of the clamping member 46 bears against the inner telescopic element 38 to prevent minor cyclic movement between the telescopic members.

Gear box 8 mounted on the distal end of the boom 6 has a journal bearing 48 in which a crank shaft 50 is mounted. First and second cranks 52 and 54 have proximal ends 56 connected to the crank shaft 50. Distal ends 58 are connected to pedals 60, which extend generally horizontally. The pedals 60 have toe clips 62 in a preferred embodiment to hold the feet of a user in proper alignment on the pedals 60. Moreover, the toe clips 62 allow the expressing of flexor muscles, as well as extender muscles, and provide total leg exercise and increase the value of the aerobic exercise.

Gear box 8 includes gears 64, which increase the speed of rotation of the input and transmits it to the proximal end 66 of drive shaft 68. Universal joints 70 and 72 may be provided on the distal and proximal ends of the drive shaft to provide proper height and alignment positioning of the gear box, drive shaft and flywheel 74. A coupling 76 connects the drive shaft 68 to the flywheel.

An energy absorbing means 80 is mounted beneath the seat to absorb the work of the drive shaft. Gauge 82 registers the total work.

Figure 2:
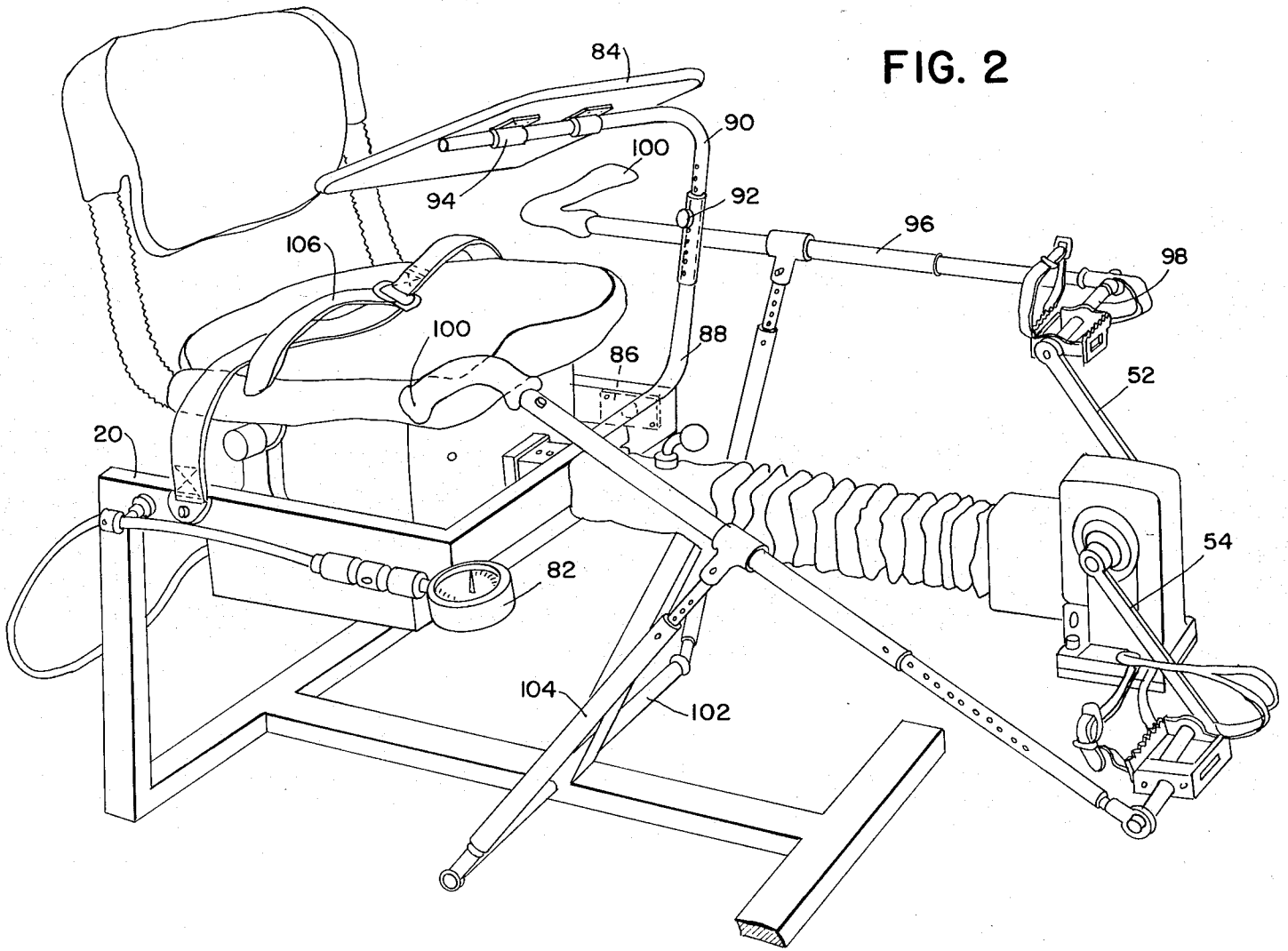
FIG. 2 is a perspective view of a modified exercising apparatus of the present invention.

As shown in FIG. 2, desk 84 is added to the preferred form of the invention by mounting a support 86 on one of the rails 20. An L-shaped telescoping arm 88 is connected to support 86. An inner L-shaped telescoping arm 90 slides within arm 88 and is fixed in position by screw pin 92. Brackets 94 connect the desk 84 to arm 90.

In one embodiment of the invention, adjustable telescopic connecting arms 96 are connected to pedals by extensions 98. Handles 100 permit operating of the cranks 52 and 54 by hand.

In one embodiment, to keep handles 100 within reach of a chair, a transverse rod 102 is connected to the frame and adjustable idler rods 104 are connected to opposite ends of transverse rod 102 and are hinged to medial portions of connecting rods 96. In one preferred embodiment of the invention, a seat belt 106 is connected to rails 20 to maintain the user positioned in the chair, especially when operating handles 100.

The handles 100 can be used to exercise the upper body or can be used simultaneously with the leg exercising pedals. The analog workload readout meter 82 enables one to determine how much work is outputted.

In a preferred form of the invention, a bellows 108 covers the telescoping boom members 36 and 38 for neatness of appearance and to prevent clothing or leg contact with the metallic boom members.

Figure 3:
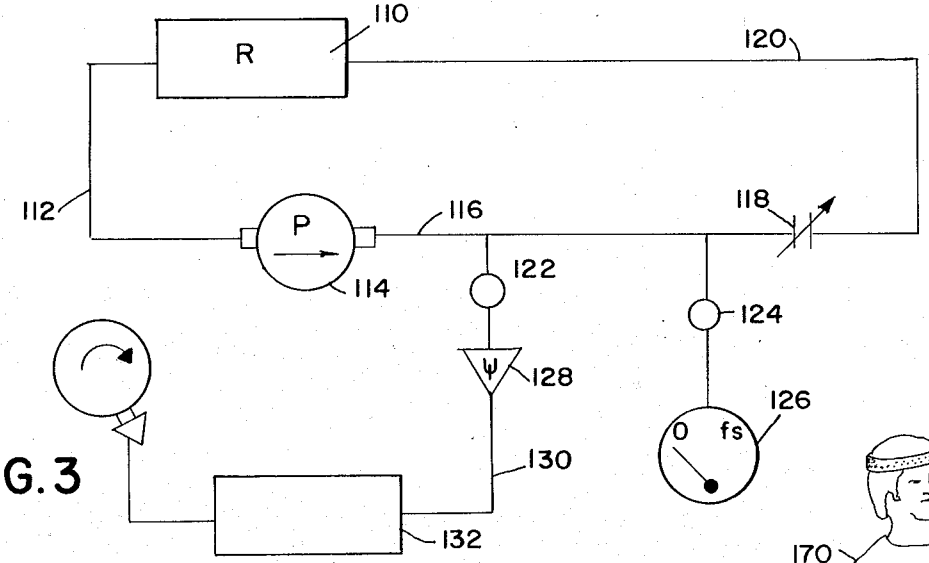
FIG. 3 is a schematic representation of a hydraulic energy absorbing and measuring system.

A preferred form of the invention uses hydraulics as an energy absorbing resistance unit, as schematically represented in FIG. 3. Hydraulic reservoir 110 supplies hydraulic fluid to an input line 112 of hydraulic pump 114, which is connected to the proximal end of the drive shaft 68 and coupled to flywheel 74. The output line 116 includes a flow control valve 118 which meters the output and controls resistive pressure in output line 116. The amount of restriction is variable to allow users to select a range of resistance that is suited to their specific strength, level of fitness and specific purpose of exercise. The hydraulic pump 114 pumps fluids from reservoir 110 through output line 116 against back pressure, as selected by control valve 118. When force applied to the pedals is increased, the hydraulic pressure created by pump 114 increases and the resistance pressure in output line 116 increases. Conversely, as force on the pedals is decreased, the system resistance decreases. Thus, the system, as shown in FIG. 3, automatically compensates for the fact that pedal leverage and leg strength vary through 360 degrees of crank rotation.

Fluid is returned to reservoir 110 through low pressure line 120.

Snubbers 122 and 124 smooth pressure surges and isolate gauges and transducers from high pressure spikes. Pressure gauge 126 is connected through snubber 124 to high pressure line 116. The pressure gauge 126 may be calibrated to read out in terms of different units, for example, horse power, watts, kilogram/meters per minute or foot/pounds per minute.

Pressure transducer 128 converts the hydraulic pressure in line 116 and smoothed by snubber 122 into a proportional electrical voltage or current in electrical line 130.

The user feedback system 132 is a digital or analog meter or other electrical readout calibrated in one of several different units of work measurements. Some systems use a computer for user feedback.

Figure 4:
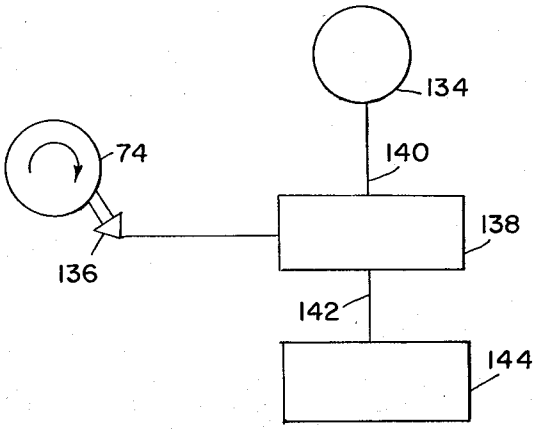
FIG. 4 is a schematic detail of an electrical resistance unit for the exercising device shown in FIG. 1.

In one embodiment of the system as shown in FIG. 4, an electromagnetic brake device 134 coupled to the flywheel 74 converts electrical current to mechanical friction. The amount of torque which is required to overcome this mechanical friction is directly proportional to the amount of electrical current applied.

A rate-of-rotation sensor 136, such as an optical photoemitter and photocell device, senses rotations of flywheel 74. As flywheel rate of rotation increases, the repetition rate of the signal from the sensor unit 136 increases. That signal is used in the brake controller unit 138 to adjust the amount of current in line 140 which is applied to brake 134. The signal from controller 138 is also sent through line 142 to the user feedback unit 144.

The magnitude of current in line 140 controls the braking resistance of brake 134 and that current can be selected by the user in accordance with the user's fitness level. Controller 138 also regulates the current in accordance with the rate of rotation of the system flywheel. An output which is representative of current being supplied to the brake unit is provided for use in the user feedback system. That output is used in conjunction with a signal from the rate-of-rotation sensor to determine the total amount of work being performed by the user. The user feedback unit may provide displays of pedal rpm and amount of resistance in the system. In some cases, the user feedback unit is a computer. In the latter cases, the data is presented to the user in one or more of several forms.

Figure 5:
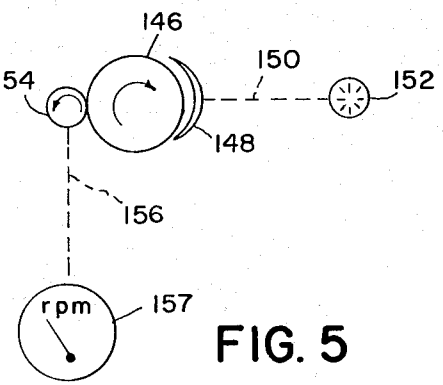
FIG. 5 is a schematic representation of a mechanical resistance unit for the exercise apparatus shown in FIG. 1.

An alternate mechanical resistance energy absorption unit is shown in FIG. 5.

A rotating disc 146 attaches to the system flywheel 74. Friction is applied against the rotating disc 146 by a disc braking pad 148 which presses against the rotating disc 146 to create system resistance. Disc braking pad adjustment shaft 150 adjusts the amount of pressure on the disc-braking pad, thereby adjusting system resistance. The tension adjuster 152 is a hand wheel adjustable by the user and is calibrated to reflect amount of torque required at the pedals to overcome frictional resistance in the unit.

A rate-of-rotation sensing wheel 154 transmits rotation through flexible cable 156 to operate a meter 157 which indicated flywheel rpms or which is calibrated to indicate pedal rpms. Brake pad 148 may be permitted to move, and a torque arm may be connected to the brake pad with a meter connected to the torque arm. Electrical outputs of the latter meter and the rpm meter 157 indicate system work.

Figure 6:
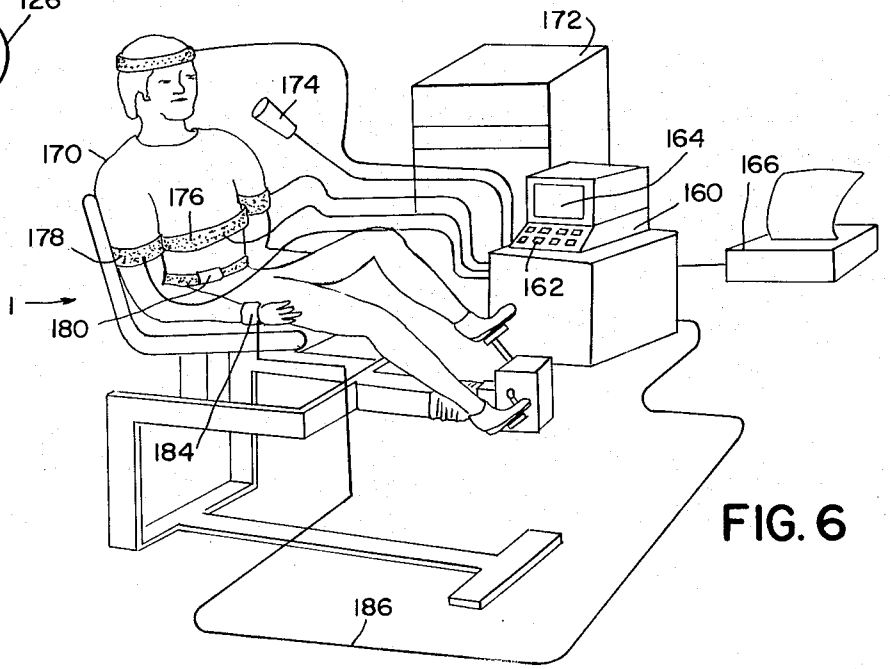
FIG. 6 is a schematic representation of an exercise system of the present invention.

In one embodiment of the invention, as shown in FIG. 6, a computer 160 is connected to the system. The computer has an alphanumeric input 162 and a monitor 164, as well as a printer 166. User 170 of the fitness system 1 has various sensors connected to the computer. For example, a vital capacity device 172 with a breath input tube 174 is connected to the computer. A respiration rate sensor 176 which surrounds the user's chest is also connected to the computer. A blood pressure cuff 178 which surrounds the user's upper arm is also connected to the computer, and pump 180 in the blood pressure cuff is controlled by the computer. A heart rate sensor 184 is also connected to the computer. Output rate signals are also connected to the computer via line 186.

The vatious electrical sensing devices connected to the body monitor metabolic functions. The computer records those functions at rest, records the energy output and records the metabolic functions at levels of energy output. The computer displays the desired energy levels and the desired time of exercise and records metabolic functions after stopping of exercise. The computer then displays the next desired exercise and the desired energy level and period. Statistics, such as identification, age, sex, weight and level of activity, may be entered manually into the computer. During exercise, the computer informs the subject of the optimum target heart rate, indicates when that rate has been achieved and indicates time remaining of the exercise at that optimum rate.

The computer also senses through its own input sensing means the amount of work being performed by the subject during the exercise.

In a preferred embodiment of the invention, the resistance unit is provided with adjustment and feedback adjustment to provide a workload that accommodates all users, without regard to present fitness level.

A preferred embodiment of the invention included the absorbed energy gauge and also includes an electronic digital gauge with which one can accurately measure one's workload. A digital heart rate monitor is also provided with a sensor attached to a finger, wrist or chest of a user. With heart rate and workload indicators, one can precisely monitor workload and heart rate relationship, provide maximum cardiovascular workout without danger of accidentally exceeding one's medically prescribed target heart rate.

The nature of the design of the present invention allows one to read, study, think, work, watch video, use a computer terminal, and perform all manner of mental activity. The device is intended to incorporate the heightened awareness and creativity developed during exercise in a productive way. The present invention is a new cardiovascular fitness apparatus that accommodates aerobic conditioning needs of all ages and conditions of people. The present invention is ergonomically designed to comfortably support the human body in a seated position. Because of the seat design and forward pedal placement, the body is secure and comfortable with no need for handlebars to help maintain balance. The pedal shaft is adjustable to accommodate various leg lengths.

The workload is developed by a unique gear box, drive shaft, flywheel and energy absorbing system. One preferred form uses a hydraulic system that provides an accommodating form of resistance. The hydraulic resistance has advantages over friction-type resistance mechanisms because the hydraulic system is able to provide cyclically variable resistance which precisely accommodates the strength variations and changes in the pedal leverage in different positions of the pedal strake. One result of the hydraulic system is one's ability to work at higher workloads with less joint stress. The flywheel's purpose is to cooperate with the energy absorbing system to smooth out cyclical variations caused by erratic strength inputs and variations in pedal leverage variations in different positions of the pedal stroke.

Figure 7:
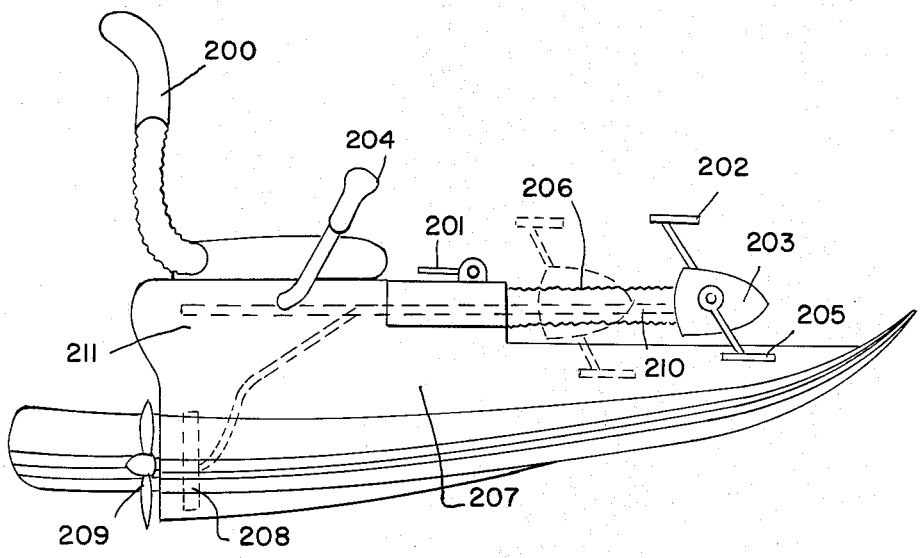
FIG. 7 is a frontal, side and top view of a human powered boat design using the drive system of the present invention.

In one embodiment of the invention, as shown in FIG. 7, the drive system is used to power a human powered boat. The input pedals 202 and 205 are connected to the speed increaser gear box 203. The speed increaser gear box 203 increases the speed of rotation of the input from the crank shaft pedals 202 and 205 and changes the direction of rotation 90 degrees transverse to the input. Drive shaft 210 transmits the work input to a flexible shaft 211 which is connected to flywheel 208 and propeller 209. A chair with a seat and back 200 is mounted to a frame enclosed within boat housing 207. The speed increaser 203 is mounted to the distal end of boom 206 that telescopes inwardly and outwardly to change the position of pedals 202 and 205 in relation to the chair 200. Locking and adjusting lever 201 cooperates with inner telescoping and outer telescoping members 206 to adjust inward and outward placement of pedals 202 and 205 and to lock inner telescopic member 206 against movement. Hand operated steering conrol 204 is located on left, right or left and right side of chair 200.

While the invention has been described with reference to specific embodiments, modifications and variations of the invention may be made without departing from the scope of the invention.

The scope of the invention is defined in the following claims:

1. Recumbent exercise apparatus comprising a frame, a chair connected to the frame and supported by the frame, the chair having a seat portion and a back portion, a boom connected to the frame and extending from the frame forward of the chair, the boom having a proximal end mounted beneath the chair and a distal end remote from the chair, journal bearing means connected to a distal end of the boom and extending transverse to the boom in a generally horizontal direction, a shaft mounted in the journal bearing, the shaft having first and second opposite ends, first and second crank means, each having proximal and distal ends of the first and second cranks, the pedal means extending generally horizontally outward from the distal ends, and means, for providing resistance to the turning of the shaft by the pedal means and cranks, wherein the shaft comprises a crank shaft and further comprising a drive shaft extending rearwardly from the distal end of the boom to the proximal end of the boom and further comprising gear means at the distal end of the boom for connecting the crank shaft and drive shaft and for increasing the speed of rotation of the drive shaft in relation to the crankshaft and further comprising energy absorbing means connected to the frame at a proximal end of the boom and connected to an end of the drive shaft adjacent the proximal end of the boom for absorbing energy from the drive shaft, which energy is delivered to the drive shaft by the crank shaft.

2. The exercise apparatus of claim 1 wherein the boom is adjustable in length, whereby the journal bearing may be adjusted to different distances from the chair.

3. The exercise apparatus of claim 2 wherein the boom is adjustable by telescopically varying the length of the boom adjacent the chair.

4. The exercise apparatus of claim 1 wherein the boom has a portion which slides through the frame and which is adjustable with respect to the frame to vary the distance of the journal bearing from the chair.

5. The apparatus of claim 1 wherein the chair is adjustable along the frame to vary the position of the chair with respect to the frame.

6. The apparatus of claim 1 further comprising trunnion means connected to the frame and to the chair and locking means connected to the trunnion means whereby the chair is rotatable rearwardly and forwardly with respect to the frame.

7. The apparatus of claim 1 further comprising a flywheel connected to the drive shaft near the proximal end of the boom.

8. The apparatus of claim 7 further comprising gauge means connected to the energy absorbing means for indicating the energy absorbed by the energy absorbing means and work produced on the drive shaft.

9. The apparatus of claim 8 wherein the boom comprises an outer telescopic member rigidly connected to the frame and an inner telescopic member slidable within the outer telescopic member, wherein the inner and outer telescopic members have complementary means for adjusting and stabilizing the telescoping members.

10. The apparatus of claim 9 further comprising a clamp means mounted on the outer telescopic member and engageable with the inner telescopic member for clamping the members against movement.

11. The apparatus of claim 10 wherein the drive shaft extends through the inner telescopic member.

12. The apparatus of claim 11 wherein the energy absorbing means comprises an electrical generator coupled to the flywheel, load means electrically connected to the generator and sensing means connected to an electrical connection between the load means and the generator.

13. The apparatus of claim 11 wherein the energy absorbing means comprises an electromagnetic brake coupled to the flywheel and a rate-of-rotation sensor connected to the frame for sensing rotations of the flywheel and current adjusting means connected to the sensor and to the electromagnetic brake for varying braking as flywheel rotation varies.

14. The exercise apparatus of claim 13 further comprising magnetic brake controller means connected to the electromagnetic brake and control means connected to the frame adjacent the chair whereby a user may control ratio of braking to flywheel speed.

15. The apparatus of claim 1 wherein the energy absorbing means comprises a rotating disc connected to the flywheel, a disc braking pad connected to the speed sensing means and to the disc braking pad for adjusting the pad as the speed of the flywheel varies.

16. The exercising apparatus of claim 15 further comprising control means connected to feedback means for controlling the ratio of braking feedback to the flywheel rotation whereby a user may adjust a ratio of braking to flywheel speed.

17. The exercise apparatus of claim 1 wherein the energy absorbing means comprises a pump means connected to the frame and coupled to the flywheel, intake and output means connected to the pump means, a hydraulic fluid reservoir connected to the frame and connected to the intake means for supplying hydraulic fluid to the pump means, flow control valve means connected to the output means for restricting flow of fluid from the pump means through the output means, control means connected to the valve means for controlling restriction of the valve means, pressure transducer means connected to the output means for converting hydraulic pressure in the output means into electrical voltage and meter means connected to the transducer means for indicating power, feedback means connected to the transducer means and to the control means for controlling the valve means in response to electrical output of the transducer means.

18. The apparatus of claim 17 further comprising means connected to the output means for smoothing pressure surges in the output means.

19. The exercise apparatus of claim 1 wherein the frame means comprises a longitudinal base member generally parallel to the boom, the longitudinal base member having distal and proximal ends, a transverse base member connected to the distal end of the longitudinal base member for resisting rotation around an axis of the base member, an upward extending member extending upwardly from a medial portion of the longitudinal base member and connected to the boom for supporting the boom, a rear transverse member connected to the proximal end of the longitudinal base member, upright members connected to the rear transverse member, rail members connected to the upper members and extending generally horizontally and forwardly generally parallel to the longitudinal base member, a cross member connected to the rail members and means for supporting the boom in the cross member, trunnion means connected to the rail members and wherein the chair is connected to the trunnion means.

20. The apparatus of claim 19 further comprising seatbelt means connected to the rail members and extending upward over the seat.

21. The apparatus of claim 19 further comprising desk means connected to the rail members and extending upward therefrom above the seat portion of the chair and forward of the chair for permitting a user to read or write while exercising.

22. The apparatus of claim 19 further comprising first and second connecting rod means having distal and proximal ends, first and second handle means respectively mounted on proximal ends of the connecting rod means near the chair means and first and second means for respectively connecting distal ends of the connecting rods to the pedal means at distal ends of respective first and second cranks.

23. The exercise apparatus of claim 19 further comprising transverse rod means connected to the frame means beneath the boom and having first and second idler rods, each having proximal and distal ends, proximal ends of the first and second idler rods being respectively connected to first and second ends of the transverse rod and distal ends of the first and second idler rods being respectively hinged to medial portions of connecting rods, whereby handles are supported upward near the chair.

24. The apparatus of claim 1 further comprising first and second toe clips respectively connected to the first and second pedal means for providing lifting and pulling flexure exercise to a user, as well as pushing extension exercise to a user.

* * * * *